US006535234B2

(12) United States Patent
Ohno et al.

(10) Patent No.: US 6,535,234 B2
(45) Date of Patent: Mar. 18, 2003

(54) METHOD FOR SETTING QUANTITY OF LIGHT OF LIGHT-EMITTING ELEMENT ARRAY

(75) Inventors: Seiji Ohno, Osaka (JP); Yukihisa Kusuda, Osaka (JP); Shunsuke Ohtsuka, Osaka (JP); Yasunao Kuroda, Osaka (JP); Takahisa Arima, Osaka (JP); Hideaki Saitou, Osaka (JP)

(73) Assignee: Nippon Sheet Glass Co., Ltd., Osaka (JP)

( * ) Notice: Subject to any disclaimer, the term of this patent is extended or adjusted under 35 U.S.C. 154(b) by 0 days.

(21) Appl. No.: 09/937,042

(22) PCT Filed: Jan. 22, 2001

(86) PCT No.: PCT/JP01/00376

§ 371 (c)(1),
(2), (4) Date: Sep. 20, 2001

(87) PCT Pub. No.: WO01/56801

PCT Pub. Date: Aug. 9, 2001

(65) Prior Publication Data

US 2002/0158586 A1 Oct. 31, 2002

(30) Foreign Application Priority Data

Jan. 31, 2000 (JP) ..... 2000-021450

(51) Int. Cl.[7] ..... B41J 2/385

(52) U.S. Cl. ..... 347/129; 347/130; 347/131; 347/254

(58) Field of Search ..... 347/129, 130, 347/131, 192, 196, 254, 253, 188, 363

(56) References Cited

U.S. PATENT DOCUMENTS 5,153,605 A * 10/1992 Ohara et al. ..... 347/184
5,614,936 A * 3/1997 Takahashi ..... 347/240
5,689,297 A * 11/1997 Yokoyama et al. ..... 347/188

FOREIGN PATENT DOCUMENTS

JP 60-64870 4/1985
JP 10-258545 9/1998

* cited by examiner

*Primary Examiner*—Don Wong
*Assistant Examiner*—Tuyet T. Vo
(74) *Attorney, Agent, or Firm*—RatnerPrestia

(57) ABSTRACT

A method for setting the amount of light in an array of light-emitting thyristors, each thyristor having I-L characteristic in which a luminous efficiency is decreased in a lower current field, is provided. According to the method, the amount of light emitted from a light-emitting thyristor is set so that a predetermined exposure energy may be obtained without decreasing a luminous efficiency of a light-emitting thyristor. The density D of a current to be supplied to the light-emitting thyristor to obtain a predetermined exposure energy is selected so as to satisfy the range of $3\times D_{th}<D<100$ MA/m$^2$, wherein $D_{th}$ is a threshold current density for light emission which is defined as a current density corresponding to the value of a current at a point where a tangent drawn at the value of a current corresponding to a current density of 50 MA/m$^2$ with respect to the curve of the I-L characteristic intersects a current axis.

3 Claims, 4 Drawing Sheets

METHOD FOR SETTING QUANTITY OF LIGHT OF LIGHT-EMITTING ELEMENT ARRAY

TECHNICAL FIELD

The present invention relates to a method for setting the amount of light in a light-emitting element array, particularly to a method for setting the amount of light for a light-emitting element array in which light-emitting thyristors are arrayed, each thyristor having a current-light output characteristic in which a luminous efficiency is decreased in a lower current field.

BACKGROUND ART

A light-emitting diode (LED) is generally used for a light-emitting element array in an optical print head an optical printer. In a light-emitting element array using LEDs, an array pitch of LEDs is determined by a critical pitch of wire bonding method, i.e. 500 dpi (dots per inch). Therefore, it is impossible to increase a resolution of a light-emitting element array by arraying LEDs at high density.

In order to resolve this problem, the applicant has already proposed a light-emitting element array using a three-terminal light-emitting thyristor of pnpn-structure, to which Japanese Patent has been issued (Japanese Patent No.2807910) that is hereby incorporated by reference.

According to this patent, an array of light-emitting elements is divided into blocks n by n (n is an integer≧2), the gates of n light-emitting thyristors included in each block are separately connected to n lines, and the anodes or cathodes of n light-emitting elements included in each block are commonly connected to one electrode, respectively. In this manner, the number of electrodes to supply signals for light emission may be decreased, so that an array pitch of light-emitting elements becomes smaller.

An I-L (current-light output) characteristic of a three-terminal light-emitting thyristor is not a straight line passing through an origin of orthogonal coordinates. FIG. 1 shows an I-L characteristic of a three-terminal light-emitting thyristor which has an area of light-emitting portion of 20 $\mu$m×20 $\mu$m. An abscissa designates a current (mA), and an ordinate a light output ($\mu$W). The I-L characteristic varies linearly in the field larger than 10 mA and light is emitted, but light is not substantially emitted in the field smaller than 5 mA. Therefore, a luminous efficiency becomes lower when a light-emitting thyristor is used in a smaller current field, and then a power consumption for obtaining a required exposure energy is increased, resulting in the temperature increasing of an optical print head.

On the other hand, when a current density in a light-emitting portion of the thyristor is increased, the reduction of the amount of light due to current supply becomes extremely larger. The reduction of the amount of light is proportional to the time duration of current supply and is increased exponentially with respect to the current density. FIG. 2 shows the variation of the amount of light due to the time duration of current supply. An abscissa designates time (Hour), and an ordinate the reduction (%) of the amount of light from an initial value.

Referring to FIG. 3, there is shown a graph designating the reduction of the amount of light after 1000 hours of current supply, which is obtained from the result shown in the graph of FIG. 2. It is recognized from FIG. 3 that a current density should be smaller than 100 MA/m$^2$ in order to hold the decrease of the amount of light within 2%. It has also been known that the current density such as 100 MA/m$^2$ is an upper limit in LED for communication, and lattice defects are extremely increased at a current density more than 100 MA/m$^2$. Therefore, it is desirable that the density of a current supplied to a light-emitting thyristor is smaller than 100 MA/m$^2$. In the case of a three-terminal light-emitting thyristor having a light-emitting portion area of 20 $\mu$m×20 $\mu$m, a current through the light-emitting portion corresponds to 40 mA when a current density is 100 MA/m$^2$.

Consequently, it is required that the amount of light emitted from a light-emitting thyristor is set so that a predetermined exposure energy may be obtained without decreasing a luminous efficiency of a light-emitting thyristor.

DISCLOSURE OF THE INVENTION

The object of the present invention is to provide a method for setting the amount of light for an array in which a plurality of light-emitting elements such as light-emitting thyristors are arrayed, each light-emitting element or thyristor having an I-L characteristic which is not a straight line passing through an origin of orthogonal coordinates, the method being adapted so that a predetermined exposure energy may be obtained without decreasing a luminous efficiency.

According to the present invention, in a light-emitting thyristor having an I-L characteristic in which a luminous efficiency is decreased in a lower current field, the density D of a current to be supplied to the light-emitting is selected so as to satisfy the range of $3\times D_{th}<D<100$ MA/m$^2$, wherein $D_{th}$ is a threshold current density for light emission which is defined as a current density corresponding to the value of a current at a point where a tangent drawn at the value of a current corresponding to a current density of 500 MA/m$^2$ with respect to the curve of the I-L characteristic intersects a current axis of a graph designating the I-L characteristic.

When an exposure energy is regulated in a multiple gradation manner, the graduation of the exposure energy is regulated by modulating the time duration of light emission of the thyristor, or both of the value of a current and the time duration of light emission of the thyristor.

BEST MODE FOR CARRYING OUT THE INVENTION

The embodiments of the method for setting the amount of light in light-emitting element array according to the present invention will now be described with reference to the drawings.

Embodiment 1

Figure 1:
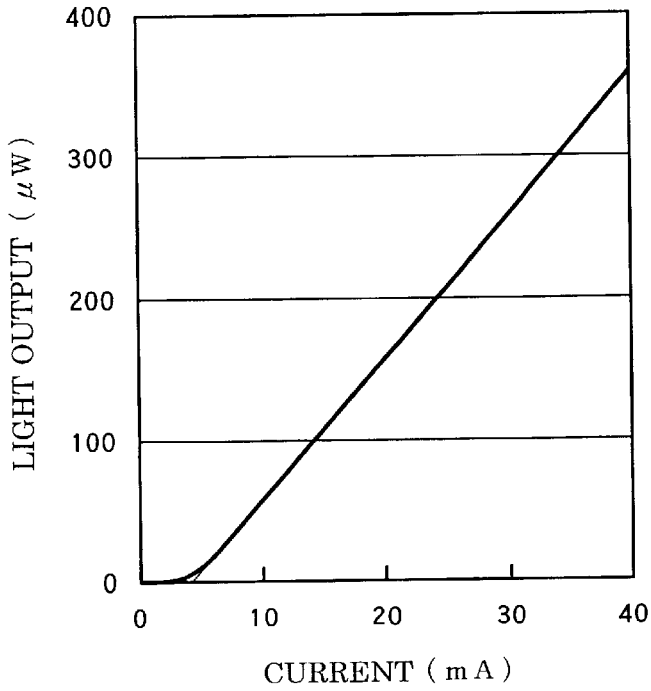
FIG. 1 is a graph illustrating an I-L characteristic of a three-terminal light-emitting thyristor which has an area of light-emitting portion of 20 $\mu$m×20 $\mu$m.
Figure 2:
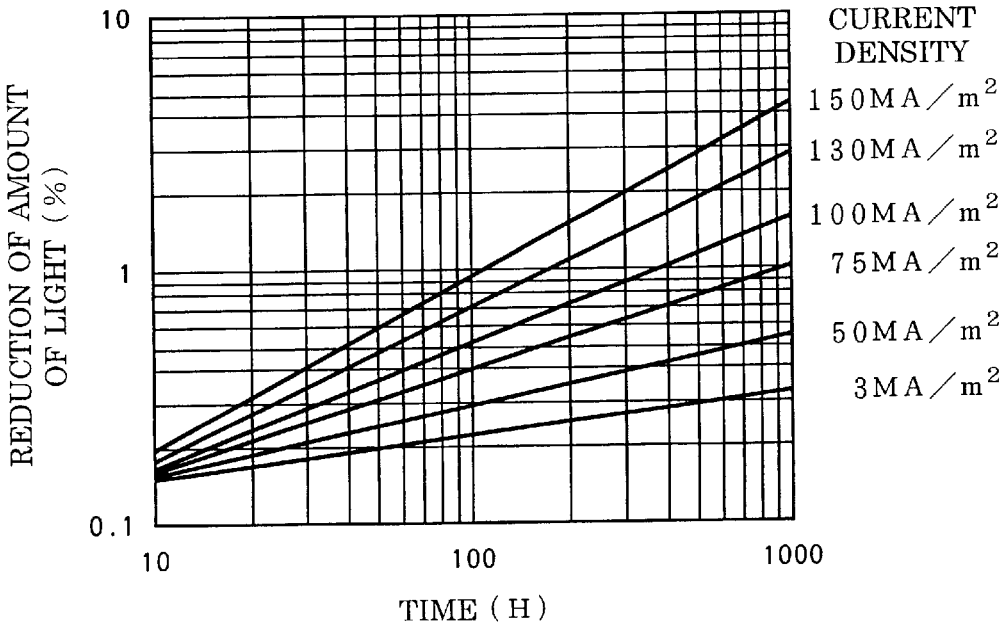
FIG. 2 is a graph illustrating the variation of the amount of light due to the time duration of current supply.
Figure 3:
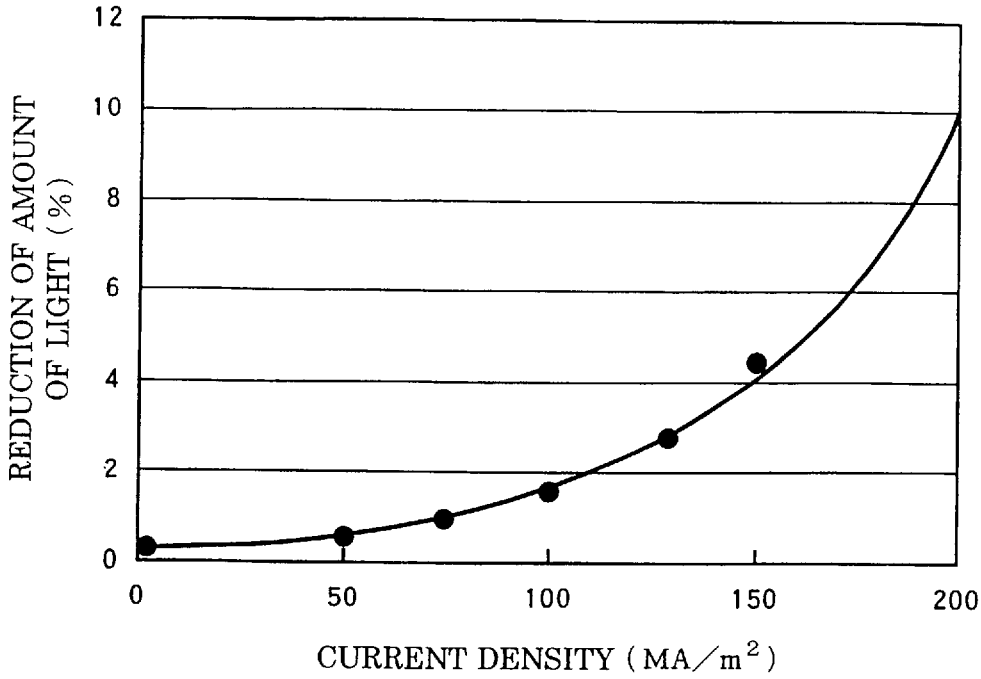
FIG. 3 is a graph designating the reduction of the amount of light after 1000 hours of current supply.

A current and a time duration of light emission are now considered in the case of fabricating an optical print head by using light-emitting thyristors each having an I-L characteristic as shown in FIG. 1. It is noted that light-emitting thyristors each having an area of a light-emitting portion of 20 $\mu$m×20 $\mu$m is used in this embodiment.

Figure 4:
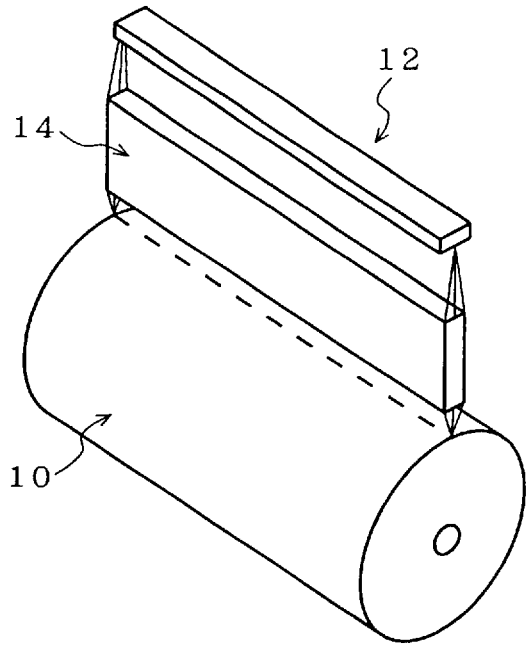
FIG. 4 shows the structure of an optical print head.

First, the structure of a print head used in an electrophotographic printer is explained briefly. FIG. 4 shows an optical print head provided above a photosensitive dram 10. The optical print head is consisted of a light-emitting thyristor array 12 in which a plurality of thyristors are arrayed in one line and a rod lens array 14 in which a plurality of rod lenses are stacked. The rod lens array 14 is arranged in perpendicular to a target plane of the photosensitive dram 10 and in parallel with a surface of the photosensitive dram. The light-emitting thyristor is arranged in such a manner that the light from the light-emitting thyristor array 12 impinges upon the photosensitive dram 10 through the rod lens array 14.

In the electrophotographic printer, an exposure energy required for two-graduation record is about 1–10 mJ/m$^2$. Assuming that a required exposure energy is 6 mJ/m$^2$ and a coupling efficiency a rod lenses is 4%, an output energy of a light-emitting element per dot is 270 pJ in the case of 600 dpi (42.3 $\mu$m pitch). When one paper of A3 size is printed per second, a time duration required for printing one line is about 100 $\mu$s. Therefore, a light output of 270 pJ/100 $\mu$s=2.7 $\mu$W is required for a light-emitting element. In accordance with the I-L characteristic in FIG. 1, a current of about 2.7 mA must be supplied in order to obtain a light output of 2.7 $\mu$W. On the other hand, if a current of 40 mA which corresponds to the current density of 100 MA/m$^2$ is supplied, a light output of 360 $\mu$W is obtained in accordance with the I-L characteristic in FIG. 1. Accordingly, if the time duration of light emission is selected as 100 $\mu$s×2.7 $\mu$W/360 $\mu$W=0.75 $\mu$S, the same exposure energy may be obtained as in the case that the time duration of light emission is 100 $\mu$S and a current to be supplied is 2.7 mA.

A voltage across terminals of a light-emitting thyristor is substantially constant in spite of the magnitude of a current to be supplied, so that a power to be consumed in a light-emitting thyristor is proportional to the magnitude of a current to be supplied. Therefore, the energy to be consumed in a light-emitting thyristor is proportional to the product of the magnitude of a current and the time duration of light emission. That is, the ratio between the energy to be consumed in the case of 40 mA and that in the case of 2.7 mA for obtaining the same exposure energy is (40 mA×0.75 $\mu$S)/(2.7 mA×100 $\mu$s)=⅙. Consumed energy is changed into heat as it is, so that the heat elevation in the case of 40 mA may be suppressed by a factor of 9 compared with the case of 2.7 mA.

While the example is illustrated herein, in which a current of 40 mA corresponding to 100 MA/m$^2$ as a maximum current which does not affect the lifetime of a light-emitting thyristor, any magnitude of current may be used if it is smaller than 40 mA and an enough luminous efficiency is obtained.

According to the I-L characteristic as shown in FIG. 1, it has a linear characteristic in the field larger than 10 mA. It is therefore considered that a tangent $L_1$ (L=aI+b) at a current density of 50 MA/m$^2$ which is half of 100 MA/m$^2$ is used for a primary approximate expression with respect to the curve of this I-L characteristic. It is assumed in the tangent $L_1$ that a light output L equals to zero (L=0) in the field of L<0. The value (i.e., a threshold current $I_{th}$ for light emission) at the point where the tangent $L_1$ intersects a current axis (i.e., an abscissa) is $I_{th}$=−b/a.

Figure 5:
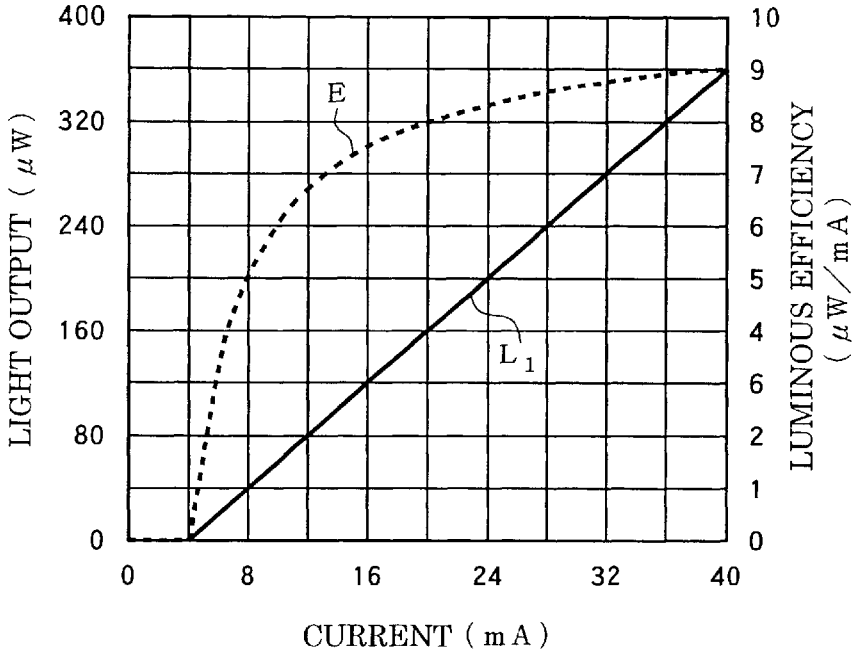
FIG. 5 is a graph illustrating the calculated result of luminous efficiency.

When the approximate expression $L_1$ is now obtained from the I-L characteristic in FIG. 1, a is 10 $\mu$W/mA and b is −40 $\mu$W. At this time, a threshold current for light emission $I_{th}$ is 4 mA, and a threshold current density $D_{th}$ is 10 MA/m$^2$. FIG. 5 shows a graph illustrating the approximate expression $L_1$ and the result of a luminous efficiency E=L/I calculated from the approximate expression $L_1$. In the graph, a solid line designates the approximate expression $L_1$ and a dotted line the calculated luminous efficiency. It is recognized from the graph of FIG. 5 that the luminous efficiency E sharply increases when a current becomes larger than the threshold value $I_{th}$, goes to about 7 $\mu$W/mA at 3×$I_{th}$, and is gradually saturated. When the value of a current increases infinitely, E becomes 10 $\mu$W/mA. Therefore, it is recognized that a luminous efficiency which is 70% of an ideal value may be obtained at 3×$I_{th}$.

Figure 6:
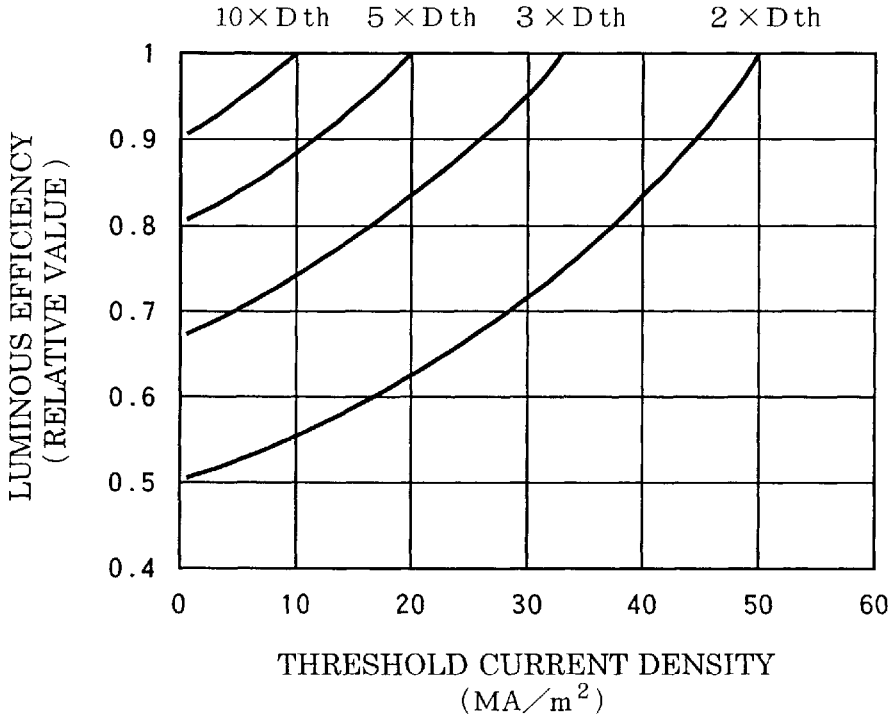
FIG. 6 is a graph illustrating the calculated results which show how a luminous efficiency is varied when the value of the threshold current is changed.

FIG. 6 illustrates a graph designating the calculated results which show how a luminous efficiency is varied when the value of the threshold current $I_{th}$ is changed. In the graph, an abscissa designates a threshold current density $D_{th}$ and an ordinate a relative value of a luminous efficiency assuming that a luminous efficiency is "1" when a current density D is 100 MA/m$^2$. It is recognized from the graph of FIG. 6 that a relative value of 0.66 or more may be obtained when a current density which is three times or more $D_{th}$.

It is appreciateed from the consideration described above that the current density D is to be selected so as to satisfy the range of 3×$D_{th}$<D<100 MA/m$^2$, in order to obtain a predetermined exposure energy without decreasing a luminous efficiency.

Embodiment 2

When the amount of light is modulated only by the value of a current in order to obtain an exposure energy in a multiple gradation manner (e.g., 256-gradation), a luminous efficiency is decreased because a current density D includes the part lower than the range defined by 3×$D_{th}$<D<100 MA/m$^2$. Also, the regulation of the exposure energy in a multiple gradation manner by modulating the value of a current becomes complicated, because an I-L characteristic deviates from a straight line in the field of a small current, thereby requiring a correction data to be referenced.

In order to avoid this, the gradation is regulated by modulating the time duration of light emission, while maintaining a current density D in the field larger than 3×$D_{th}$. In the case that enough resolution is not obtained by the regulation of the gradation by modulating the time duration of light emission, both of the value of a current and the time duration of light emission may be modulated.

Figure 7:
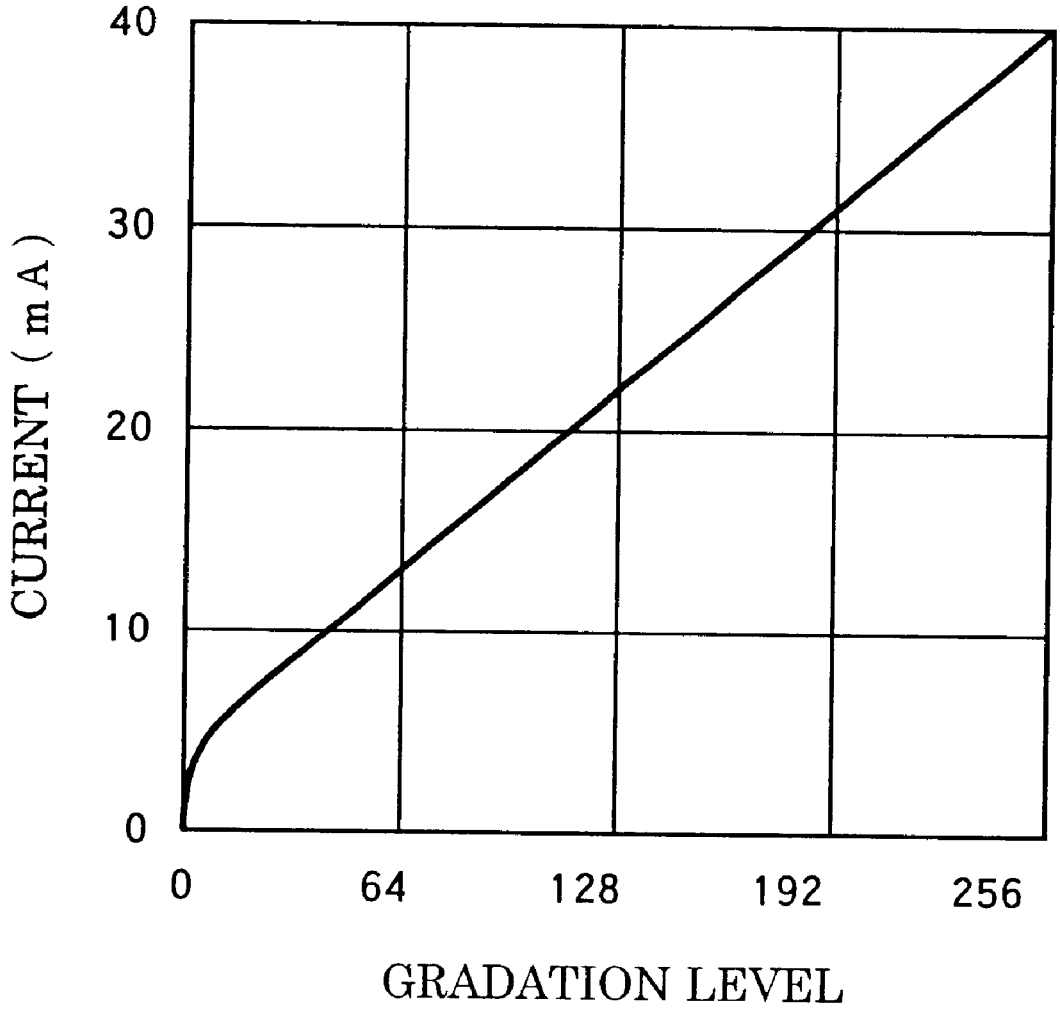
FIG. 7 is a graph illustrating the relationship of the gradation levels and the magnitude of a current in the case that 256-gradation of the exposure energy is regulated by modulating the value of a current.

In the embodiment 1, the current is 40 mA and the time duration of light emission is 0.75 $\mu$S. For the case of regulation for 256-gradation of the exposure energy by modulating the value of a current while maintaining the time duration 0.75 $\mu$S, a graph illustrating the gradation levels and the magnitude of a current is shown in FIG. 7. An average current for all gradation is 21.8 mA. Therefore, consumed power is 0.75 $\mu$S×21.8 mA×k (k is a constant). On the other hand, when 256-gradation of light is regulated by modulating the time duration of light emission, an average time duration of light emission is half of a maximum time duration of light emission, so that consumed power is (0.75 $\mu$S/2)×40 mA×k. The ratio of these consumed powers is 20/21=0.92, so that the modulation by the time duration of light emission has about 8% higher efficiency than the modulation by the magnitude of a current.

INDUSTRIAL APPLICABILITY

According to the present invention, a method for setting the amount of light is possible, in which a predetermined exposure energy may be obtained without decreasing a luminous efficiency in an array of light-emitting thyristors.

What is claimed is:

1. A method for setting the amount of light emitted from a light-emitting thyristor in order to obtain a predetermined exposure energy in a light-emitting element array in which light-emitting thyristors are arrayed, each thyristor having a current-light output (I-L) characteristic where a luminous efficiency is decreased in a lower current field, characterized in that, the density D of a current to be supplied to the light-emitting thyristor is selected so as to satisfy the range of $3\times D_{th}<D<100$ MA/m$^2$, wherein $D_{th}$ is a threshold current density for light emission which is defined as a current density corresponding to the value of a current at a point where a tangent drawn at the value of a current corresponding to a current density of 50 MA/m$^2$ with respect to the curve of the I-L characteristic intersects a current axis of a graph designating the I-L characteristic.

2. A method for setting the amount of light emitted from a light-emitting thyristor in order to obtain an exposure energy in a multiple gradation manner in a light-emitting element array in which light-emitting thyristors are arrayed, each thyristor having an I-L characteristic where a luminous efficiency is decreased in a lower current field, characterized in that, the density D of a current to be supplied to the light-emitting thyristor is selected so as to satisfy the range of $3\times D_{th}<D<100$ MA/m$^2$, wherein $D_{th}$ is a threshold current density for light emission which is defined as a current density corresponding to the value of a current at a point where a tangent drawn at the value of a current corresponding to a current density of 50 MA/m$^2$ with respect to the curve of the I-L characteristic intersects a current axis of a graph designating the I-L characteristic, and the gradation of the exposure energy is regulated by modulating the time duration of light emission of the light-emitting thyristor.

3. A method for setting the amount of light emitted from a light-emitting thyristor in order to obtain an exposure energy in a multiple gradation manner in a light-emitting element array in which light-emitting thyristors are arrayed, each thyristor having an I-L characteristic where a luminous efficiency is decreased in a lower current field, characterized in that, the density D of a current to be supplied to the light-emitting thyristor is selected so as to satisfy the range of $3\times D_{th}<D<100$ MA/m$^2$, wherein $D_{th}$ is a threshold current density for light emission which is defined as a current density corresponding to the value of a current at a point where a tangent drawn at the value of a current corresponding to a current density of 50 MA/m$^2$ with respect to the curve of the I-L characteristic intersects a current axis of a graph designating the I-L characteristic, and the gradation of the exposure energy is regulated by modulating both of the value of a current and the time duration of light emission of the light-emitting thyristor.

* * * * *

UNITED STATES PATENT AND TRADEMARK OFFICE

CERTIFICATE OF CORRECTION

PATENT NO. : 6,535,234 B2
DATED : March 18, 2003
INVENTOR(S) : Seiji Ohno et al.

It is certified that error appears in the above-identified patent and that said Letters Patent is hereby corrected as shown below:

Column 2,
Line 34, "500 MA/$m^2$" should read -- 50 MA/$m^2$ --.

Signed and Sealed this

Third Day of August, 2004

JON W. DUDAS
*Acting Director of the United States Patent and Trademark Office*